US007936316B2

(12) United States Patent
Nakajima et al.

(10) Patent No.: US 7,936,316 B2
(45) Date of Patent: May 3, 2011

(54) SMART ANTENNA

(75) Inventors: Nobuo Nakajima, Tokyo (JP); Koichi Gyoda, Tokyo (JP); Eiji Shibuya, Kobe (JP); Takehiro Onomatsu, Osaka (JP); Hideto Yoshimura, Osaka (JP)

(73) Assignees: Funai Electric Co., Ltd., Daito-shi, Osaka (JP); The University of Electro-Communications, Choufu-shi, Tokyo (JP)

( * ) Notice: Subject to any disclaimer, the term of this patent is extended or adjusted under 35 U.S.C. 154(b) by 153 days.

(21) Appl. No.: 12/156,158

(22) Filed: May 31, 2008

(65) Prior Publication Data

US 2008/0309580 A1 Dec. 18, 2008

(30) Foreign Application Priority Data

Jun. 15, 2007 (JP) ..... 2007-158680

(51) Int. Cl.
*H01Q 1/42* (2006.01)

(52) U.S. Cl. ..... 343/872

(58) Field of Classification Search ..... 343/702, 343/833, 834, 761, 872, 757, 763, 880, 882
See application file for complete search history.

(56) References Cited

U.S. PATENT DOCUMENTS

| | | | | | |
|---|---|---|---|---|---|
| 2,565,661 | A * | 8/1951 | Lidz | 343/702 |
| 2,602,892 | A * | 7/1952 | Koch | 343/702 |
| 3,710,337 | A * | 1/1973 | Grant | 343/701 |
| 4,384,290 | A * | 5/1983 | Pierrot et al. | 342/43 |
| 4,491,845 | A * | 1/1985 | Rothenberg | 343/754 |
| 5,767,807 | A * | 6/1998 | Pritchett | 342/374 |
| 5,912,646 | A * | 6/1999 | Seki et al. | 343/700 MS |
| 7,106,270 | B2 * | 9/2006 | Iigusa et al. | 343/833 |

FOREIGN PATENT DOCUMENTS

| | | | |
|---|---|---|---|
| JP | H05-006920 | U | 1/1993 |
| JP | 3041875 | U | 7/1997 |
| JP | 3044292 | U | 10/1997 |
| JP | H11-177466 | A | 7/1999 |
| JP | 2001-085921 | A | 3/2001 |

* cited by examiner

*Primary Examiner* — Michael C Wimer
(74) *Attorney, Agent, or Firm* — Yokoi & Co., U.S.A., Inc.; Toshiyuki Yokoi

(57) ABSTRACT

The present invention discloses a smart antenna that includes: a switch unit that switches a direction for receiving radio waves; and an outer covering unit that covers the smart antenna and is made of an insulating material.

7 Claims, 7 Drawing Sheets

Related Art

SMART ANTENNA

CROSS-REFERENCES TO RELATED APPLICATIONS

The present application is related to the Japanese Patent Application No. 2007-158680, filed Jun. 15, 2007, the entire disclosure of which is expressly incorporated by reference herein.

BACKGROUND OF THE INVENTION (1) Field of the Invention

The present invention relates to an antenna, especially relates to an antenna that is capable of switching directivity.

(2) Description of the Related Art

Conventionally, for example, users were adjusting a physical direction of an antenna in order to make a directivity of the antenna optimal for receiving television broadcasting signals by the antenna. However this adjusting method had a problem that this adjusting method was very difficult. So, for example, an antenna system having an indicator indicating a receiving condition of television broadcasting signals in order to manually adjust the physical direction of the antenna existed. Another antenna system that automatically adjusted the physical direction of the antenna upon user's request existed.

Further an antenna (so-called "smart antenna") that can automatically change the direction of the antenna every time preferable channels are instructed by users is suggested.

FIG. 7 is a perspective view of the smart antenna 1. According to this figure, the smart antenna 1 is comprised of an antenna unit 2 with receiving element, a chassis 3 holding the antenna unit 2, shaft portion 4 supporting the chassis 3 at a predetermined height and fixing the chassis 3 to a television receiving device, and a wiring wired from the antenna unit 2 and electrically connected to the television receiving device. According to this configuration, the smart antenna 1 is controlled by the television receiving device based on a predetermined standard through the wiring and changes the directivity.

In case connecting the smart antenna 1 mentioned above to the television receiving device, the receiving element have to be placed at a height where is upper than the television receiving device in order to improve a sensitivity of the receiving element. For example, the sensitivity of the receiving element is improved by extending general indoor antennas as the receiving element for receiving the television broadcasting signals. However the smart antenna is horizontally placed in order to switch the directivity from horizontal directions. Therefore, the chassis 3 holding the antenna unit 2 has to be placed at a height where is upper than the television receiving device. Further the smart antenna 1 has to be placed at a position where is further from the television receiving device because the smart antenna 1 has high sensitivity.

In this case, problems mentioned below are occurred. That is, the smart antenna 1 can't avoid seeing because the smart antenna 1 is placed at the height where is upper than the television receiving device. Therefore, it is a problem that the smart antenna 1 defiles the television receiving device connected to the smart antenna 1.

Regarding general desktop antennas other than the smart antennas, for improvement in appearance, inventions mentioned below are disclosed. For example, technologies that chassis cover the antennas in order to camouflage the appearance of the antennas are disclosed in Japan published patent application publication No. H11-177466A, Japan published patent application publication No. 2001-85921A, Japan published utility application publication No. H05-6920U, Japan registered utility model patent No. 3041875U and Japan registered utility model patent No. 3044292U. According to these technologies, reducing user's sense of discomfort and making up for lack of aesthetic can be achieved.

A problem mentioned below occurs in case applying above mentioned inventions for the smart antennas. That is, it is not desired that conductive substances placed around the smart antennas because the smart antennas have the high sensitivities as mentioned above. Therefore the high sensitivities of the smart antennas are harmed by camouflaging the appearance of the smart antennas by the chassis.

BRIEF SUMMARY OF THE INVENTION

The present invention discloses a smart antenna, comprising: a switch unit that switches a direction of receiving radio waves; and an outer covering unit that covers the smart antenna and is made of an insulating material.

These and other features, aspects, and advantages of invention will be apparent to those skilled in the art from the following detailed description of preferred non-limiting exemplary embodiments, taken together with the drawings and the claims that follow.

BRIEF DESCRIPTION OF THE DRAWINGS

It is to be understood that the drawings are to be used for the purposes of exemplary illustration only and the drawings are to be used not as a definition of the limits of the invention. Throughout the disclosure, the word "exemplary" is used exclusively to mean "serving as an example, instance, or illustration." Any embodiment described as "exemplary" is not necessarily to be construed as preferred or advantageous over other embodiments.

DETAILED DESCRIPTION OF THE INVENTION

The detailed description set forth below in connection with the appended drawings is intended as a description of presently preferred embodiments of the invention and is not intended to represent the only forms in which the present invention may be constructed and or utilized.

As a detailed explanation of a smart antenna according to the present invention, a television receiving system that uses the smart antenna is explained. However the smart antenna according to the present invention should not be limited to be used in the television receiving system and the smart antenna can be apply for whatever can utilize the smart antenna.

Here, embodiments of the present invention are explained, according to the following order.

A. a configuration of a television receiving system

A1. a configuration of the smart antenna

A1.1. a configuration of a chassis

A1.2. a configuration of an antenna unit
A1.3. a configuration of a shaft portion
A2. a configuration of a television receiver
B. a covering method of the smart antenna
B1. an embodiment
B2. another embodiment
C. Summary of the embodiments A. A Configuration of a Television Receiving System Here, a smart antenna and a television receiving system including the smart antenna of the best embodiment according to the present invention are explained in detail below with referencing to FIGS. 1 to 6. As well, a scope of the present invention should not be limited to exemplary drawings.

Figure 1:
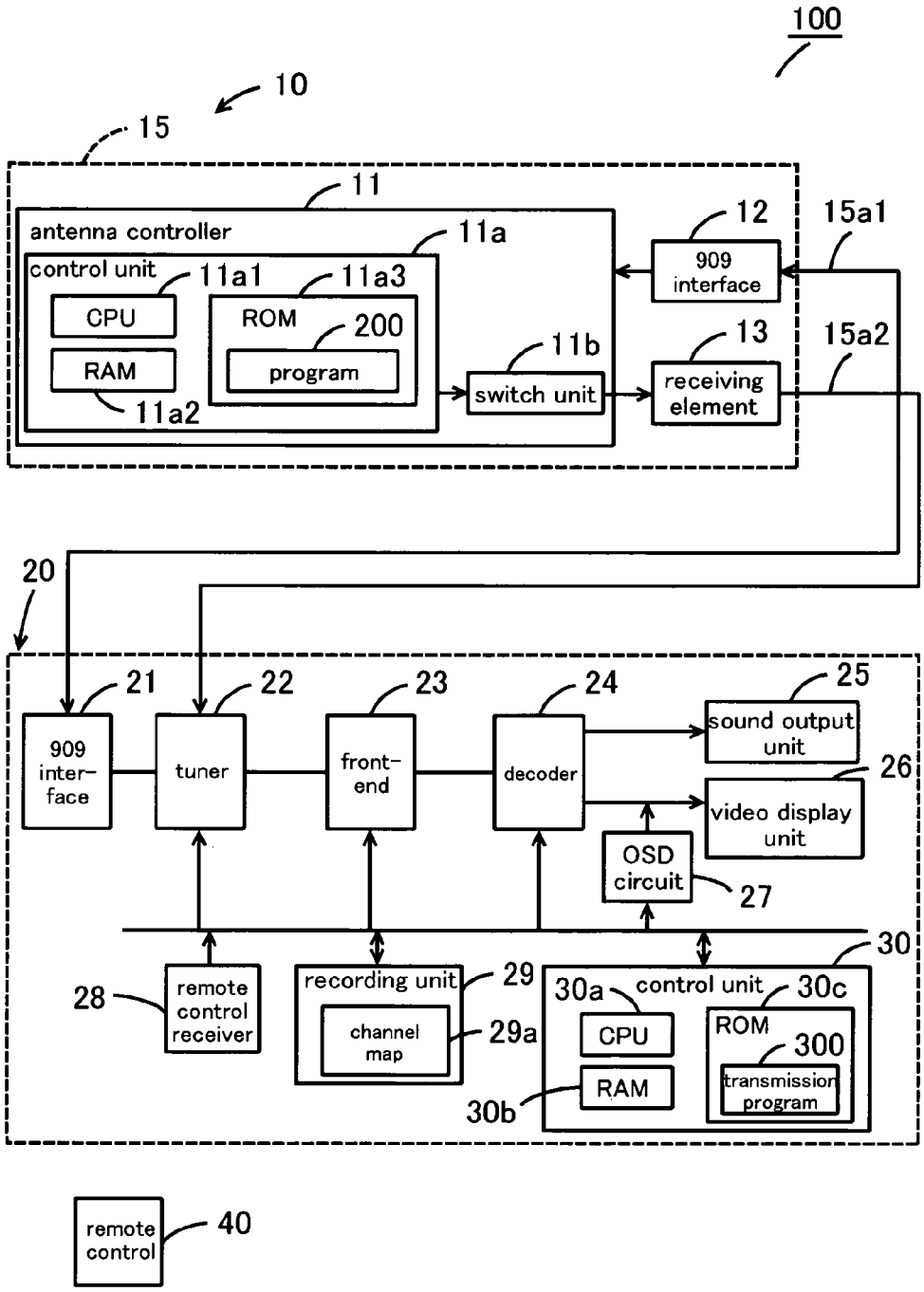
FIG. 1 is a block diagram showing a television receiving system of an embodiment of the invention.

FIG. 1 is a block diagram showing the television receiving system 100 of the present embodiment of the invention. According to FIG. 1, the television receiving system 100 is a configuration including the smart antenna 10 and a television receiver 20. For receiving television broadcasting signals, the smart antenna 10 is attached to the television receiver 20. And the smart antenna 10 and the television receiver 20 are electrically connected through a wiring.

Figure 2:
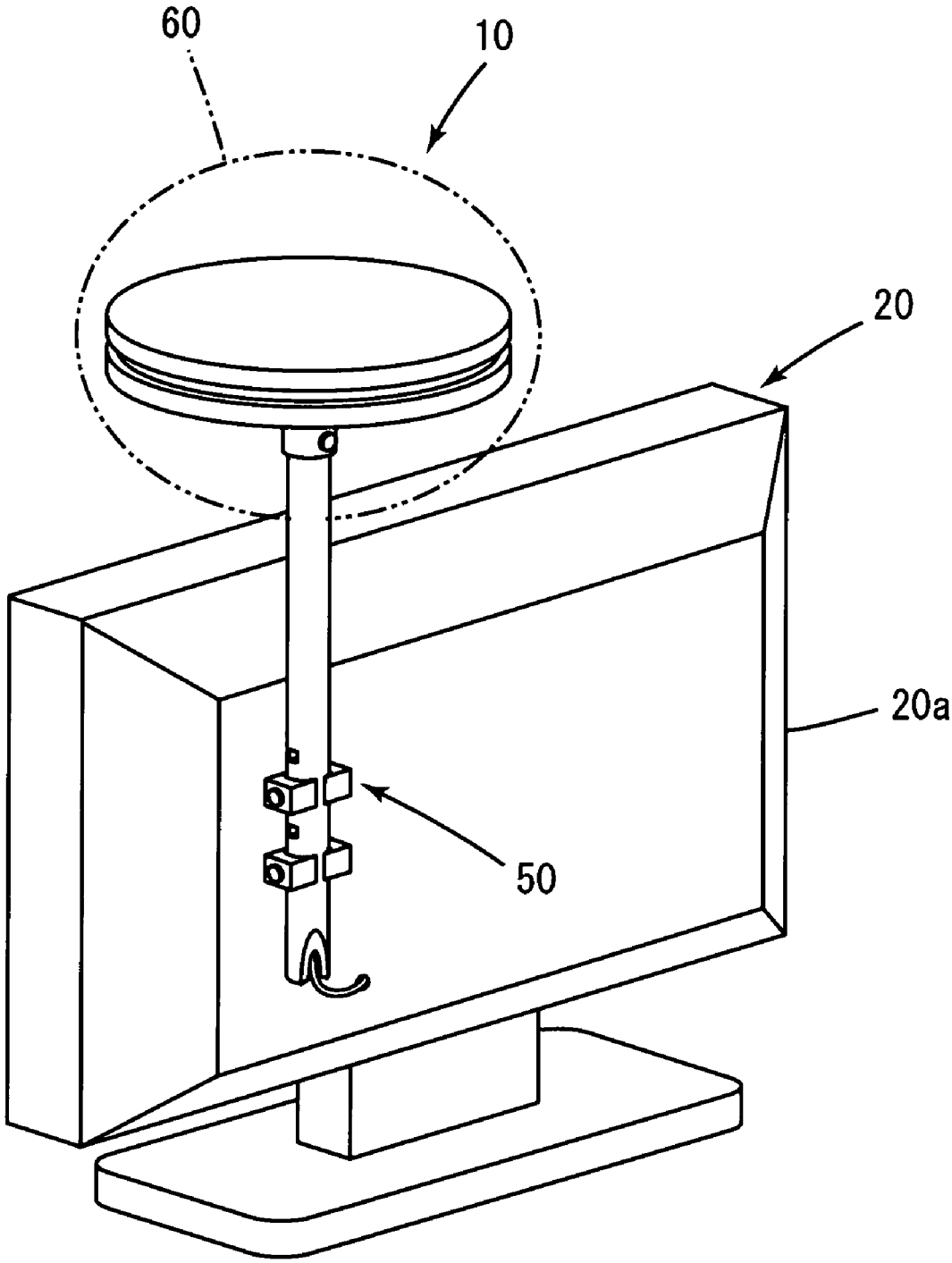
FIG. 2 is a perspective view showing a smart antenna being fixed to a television receiver.

FIG. 2 is a perspective view showing the smart antenna 10 being fixed to a television receiver 20. The smart antenna 10 and the television receiver 20 are electrically connected through an interface complying with a predetermined communication standard (EIA/CEA-909 e.g.). In what follows, this interface is described as a 909 interface. The smart antenna 10 is configured to receive the television broadcasting signals e.g. and the television receiver 20 is configured to output sounds and videos that are based on the television broadcasting signals e.g. received by the smart antenna 10. And the smart antenna 10 is fixed to the television receiver 20 to make a radial direction of a chassis (mentioned below) parallel to a ground whereon the television receiver 20 is placed. Further the chassis is arranged at a position where is upper than the television receiver 20 by a predetermined distance.

Further, the smart antenna 10 is covered by an outer covering unit 60 formed in a sphere shape so that the appearance of the smart antenna 10 can be veiled. The outer covering unit 60 can be replaced corresponding to atmosphere and design of an environment where the television receiving system 100 is arranged, because the outer covering unit 60 is detachably attached to the smart antenna 10. Therefore it is possible to prevent entire aesthetic of the television receiving system 100 from being harmed.

A1. A Configuration of the Smart Antenna

Figure 3:
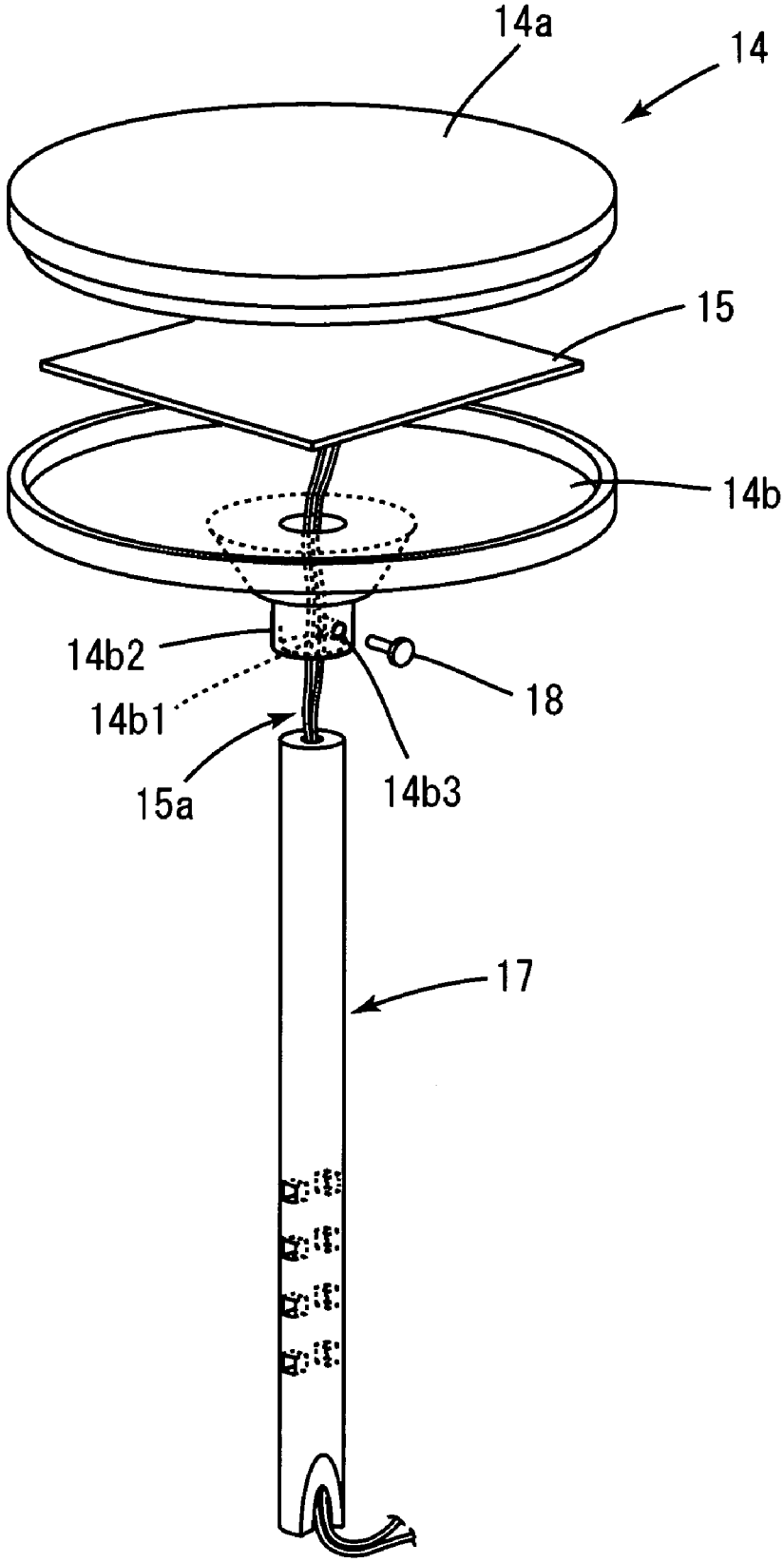
FIG. 3 is a configuration diagram of the smart antenna.

FIG. 3 is a configuration diagram of the smart antenna 10. According to FIG. 3, the smart antenna 10 has an antenna unit 15 with a receiving element 13, the chassis 14 including the receiving element 13 and a shaft portion 17. The shaft portion 17 keeps upward the chassis 14 and the antenna unit 15 contained in chassis 14 far away from the television receiver 20.

A1.1. A Configuration of a Chassis

The chassis 14 is configured for containing the antenna unit 15. The antenna unit 15 is comprised of the receiving element 13 that has directivity for receiving direction of the television broadcasting signals. Therefore, the chassis 14 holds the antenna unit 15 in order to make the receiving direction of the receiving element 13 horizontal. As an example, the chassis 14 holds the antenna unit 15 with making a circuit board that the antenna unit 15 is assembled horizontal. For that purpose, the chassis 14 is formed in a thin cylindrical shape and is comprised of an upper chassis part 14*a* and a lower chassis part 14*b* in order to be capable of horizontally containing the antenna unit 15. And the chassis 14 is made of an insulating material in order to protect the antenna unit 15 from noises from the television receiver 20.

The upper chassis part 14*a* of the chassis 14 is in a shape whose horizontal cross section is circular and has a recess wherein the antenna unit 15 can be contained. Further, the lower chassis part 14*b* is in a shape whose horizontal cross section is circular and has a recess wherein the antenna unit 15 can be placed. And the lower chassis part 14*b* had a hole 14*b*1 that leads-out a wiring (mentioned below) at a center of the horizontal cross section. The antenna unit 15 is held in the chassis 14 by coupling the upper chassis part 14*a* to the lower chassis part 14*b* so that the lower chassis part 14*b* is covered by the upper chassis part 14*a*, after placing the antenna unit 15 onto the lower chassis part 14*b* to make the wiring be lead-out through the hole 14*b*1.

A1.2. A Configuration of an Antenna Unit

The antenna unit 15 can electrically switch the directivity during receiving the television broadcasting signals. A configuration of the antenna unit 15 is explained with referencing FIG. 1. For example, the antenna unit 15 is comprised of a 909 interface 12, an antenna controller 11 and the receiving element 13 that can electrically switch the directivity during receiving the television broadcasting signals.

The 909 interface 12, for example, is connected to a 909 interface 21 (mentioned below) of the television receiver 20 through a 909 cable 15*a*1. The 909 interface 12 communicates with the 909 interface 21 of the television receiver 20 complying with the predetermined communication standard (EIA/CEA-909 e.g.), receives channel information (mentioned below) for controlling the receiving element 13 from the television receiver 20 and outputs the channel information to the antenna controller 11.

The antenna controller 11, for example, is comprised of a control unit 11*a*. The control unit 11*a*, for example, is comprised of a CPU 11*a*1, a RAM 11*a*2 and ROM 11*a*3. The CPU 11*a*1 performs several kinds of operations based on several kinds of control programs for the antenna controller 11 recorded on the ROM 11*a*3. The RAM 11*a*2 includes a program extracting area extracting the control programs performed by the CPU 11*a*1 and a data buffering area buffering data of processing results generated during performing the control programs and input data. The ROM 11*a*3 stores an operating system program capable of being performed by the CPU 11*a*1, several kinds of the control programs capable of being performed on the operating system program, data used during performing the control programs and data of processing results computed by the CPU 11*a*1. A program 200 is recorded on the ROM 11*a*3 in a computer readable form.

For example, the program 200 makes the antenna controller 11 electrically switch the directivity of the receiving element 13 based on the television broadcasting signals corresponding to physical channel identification numbers included in the channel information acquired by the CPU 11*a*1. In particular, the antenna controller 11 electrically switches the directivity of the receiving element 13 as an antenna for receiving the television broadcasting signals, based on judgments of the television broadcasting signals corresponding to physical channel identification numbers included in the channel information acquired by the CPU 11*a*1 that performs the program 200.

A switch unit 11*b*, for example, switches the directivity of the receiving element 13 based on the control signals input from the antenna controller 11. If the receiving element 13 is selected by the CPU 11*a*1 that performs the program 200, the switch unit 11*b* switches the directivity of the receiving element 13 based on the channel information acquired by the CPU 11*a*1 that performs the program 200.

The receiving element 13 is connected to a tuner 22 of the television receiver 20 through a antenna RF (radio frequency) cable and receives the television broadcasting signals based on instructions issued by the PU 11*a*1 that performs the program 200. In particular, the receiving element 13 can switch a plurality of the receiving directions (16 directions e.g.) as the directivity. If one of the receiving directions is selected, the receiving element 13 get higher sensitivity of the television broadcasting signals coming from the selected receiving direction higher than that of the television broadcasting signals coming from other receiving directions.

A1.3. A Configuration of a Shaft Portion

The shaft portion 17 is configured to support the chassis 14 and the antenna unit 15 at a position where is upper than the television receiver 20. Further the shaft portion 17, according to the present embodiment, is formed in a tubular shape and houses the 909 cable 15*a*1 and the antenna RF cable 15*a*2 as the wiring 15*a* for connecting to the television receiver 20 when the smart antenna 10 is attached to the television receiver 20. According to this configuration, the 909 cable 15*a*1 and the antenna RF cable 15*a*2 become not to be conspicuous and not to harm aesthetic feeling. In addition, the shaft portion 17 is made of an insulating material in order to protect the wiring 15*a* from the noises from the television receiver 20.

According to the configuration mentioned above, the shaft portion 17 is coupled to a connecting portion 14*b*2 extended downward from outline of the hole 14*b*1 by inserting upper edge of the shaft portion 17 into the connecting portion 14*b*2. Then the 909 cable 15*a*1 and the antenna RF cable 15*a*2 lead out from the antenna unit 15 contained in the chassis 14 through the hole 14*b*1, are inserted into a hollow center of the shaft portion 17 so as to penetrate the hollow center and are lead out from a lower edge of the shaft portion 17 that is not coupled to the chassis 14. And a female threaded hole portion 14*b*3 penetrating a side wall of the connecting portion 14*b*2 is formed in the connecting portion 14*b*2. The upper edge of the shaft portion 17 inserted into the connecting portion 14*b*2 is fixed by inserting and securing a screw 18 into the female threaded hole portion 14*b*3.

A2. A Configuration of a Television Receiver

Next, the configuration of the television receiver 20 is explained with referencing FIG. 1. The television receiver 20, for example, is comprised of the 909 interface 21, the tuner 22, a front-end 23, a decoder 24, an OSD [On Screen Display] circuit 27, a remote control receiver 28, a recording unit 29 and a control unit 30. Each of the components mentioned above is contained and placed in a cabinet 20*a*. And as shown in FIG. 2, the smart antenna 10 mentioned above is fixed by a holding part 50 formed rear side of the cabinet 20*a*.

The television receiver 20 inputs the television broadcasting signals received by the smart antenna 10 and outputs sound and video. Therefore, the television receiver 20 is comprised of a sound output unit 25 and an video display unit 26 for outputting the sound and the video. Further the television receiver 20, for example, has a remote control 40 that is capable of communicating the remote control receiver 28. Each of components of the television receiver 20 is explained below.

The 909 interface 21, for example, is connected with the 909 interface 12 of the smart antenna 10 through the 909 cable 15*a*1. For example, according to the control signals output by the control unit 30, the 909 interface 21 communicates with the 909 interface 12 of the smart antenna 10 based on the predetermined communication standard (EIA/CEA-909 e.g.). For controlling the smart antenna 10, the 909 interface 21 outputs the channel information e.g. to the smart antenna 10.

The tuner 22, for example, is electrically connected to the receiving element 13 through the antenna RF cable 15*a*2. The tuner 22 acquires the television broadcasting signals selected by users from a plurality of the television broadcasting signals according to the control signals output by the control unit 30. The tuner 22 outputs the television broadcasting signals selected by users to the front-end 23.

The front-end 23, for example, converts the broadcasting signals input from the tuner 22 into intermediate frequency signals and output the intermediate frequency signals to the decoder 24 according to the control signals input from the control unit 30.

According to the control signals output by the control unit 30, the decoder 24, for example, decodes the intermediate frequency signals and generates sound signals and video signals by executing processes complying with a predetermined format (MPRG-2[Moving Picture Experts Group phase 2] e.g.). Then the decoder 24 outputs the decoded sound signals to the sound output unit 25 and outputs the decoded video signals to the video display unit 26.

The sound output unit 25, for example, is a speaker device, and outputs sounds based on the sound signals input from the decoder 24.

The video display unit 26, for example, is a crystalline liquid display device, and outputs videos based on the video signals input from the decoder 24. The video display unit 26 also outputs the videos whereon OSD signals (mentioned below) output by the OSD [On Screen Display] circuit 27 are superimposed.

According to the control signals output by the control unit 30, the OSD circuit 27, for example, superimpose the OSD signals for displaying OSD at the video display unit 26 onto the video signals input to the video display unit 26 from the decoder 24.

The remote control receiver 28, for example, receives some kinds of signals transmitted by the remote control 40 and outputs some kinds of data based on the signals to the control unit 30.

The remote control 40, for example, is operated by the users and transmits the signals corresponding to operations. In particular, the remote control 40 has channel-keys and channel-up/down-keys that are operated to instruct what channels to receive.

The recording unit 29, for example, is comprised of any of a magnetic recording media, an optical recording media and a semiconductor recording media. In particular, a channel map 29*a* is recorded by the recording unit 29. The channel map 29*a*, for example, stores channel information. In particular, the channel map 29*a*, for example, records virtual channel numbers and physical channel numbers assigned with the channel-keys of the remote control 40, directivity information specifying the receiving directions of the smart antenna 10 and gain information concerning to receiving gain of the smart antenna 10. The information recorded in the channel map 29*a*, for example, are determined and recorded in the channel map 29*a* when initial setting of the television receiving system 100 is performed.

The control unit 30, for example, is comprised of a CPU 30*a*, a RAM 30*b* and a ROM 30*c*. The CPU 30*a* performs several kinds of operations based on several kinds of control programs for the television receiver 20 recorded on the ROM 30*c*. The RAM 30*b* includes a program extracting area extracting the control programs performed by the CPU 30*a* and a data buffering area buffering data of processing results generated during performing the control programs and input data.

The ROM 30*c* stores an operating system program capable of being performed by the CPU 30*a*, several kinds of the control programs capable of being performed on the operating system program, data used during performing the control programs and data of processing results computed by the CPU 30*a*. For example a transmission program 300 is recorded on the ROM 30*c* in a computer readable form.

The transmission program 300, for example, makes the CPU 30*a* perform a function for transmitting the channel information to the smart antenna 10 through the 909 interface 21. In particular for example, when one of the channels is selected by user's operations of the channel-keys and the channel-up/down-keys of the remote control 40, the CPU 30*a* acquires the channel information (the physical channel number, the directivity information and the gain information) corresponding to the selected channel from the channel map 29*a* recorded by the recording unit 29 and transmits the channel information to the antenna controller 11 of the smart antenna 10 through the 909 interface 21. This leads the smart antenna 10 switches the directivity and receives the selected channel.

B. A Covering Method of the Smart Antenna

B1. An Embodiment

Figure 4:
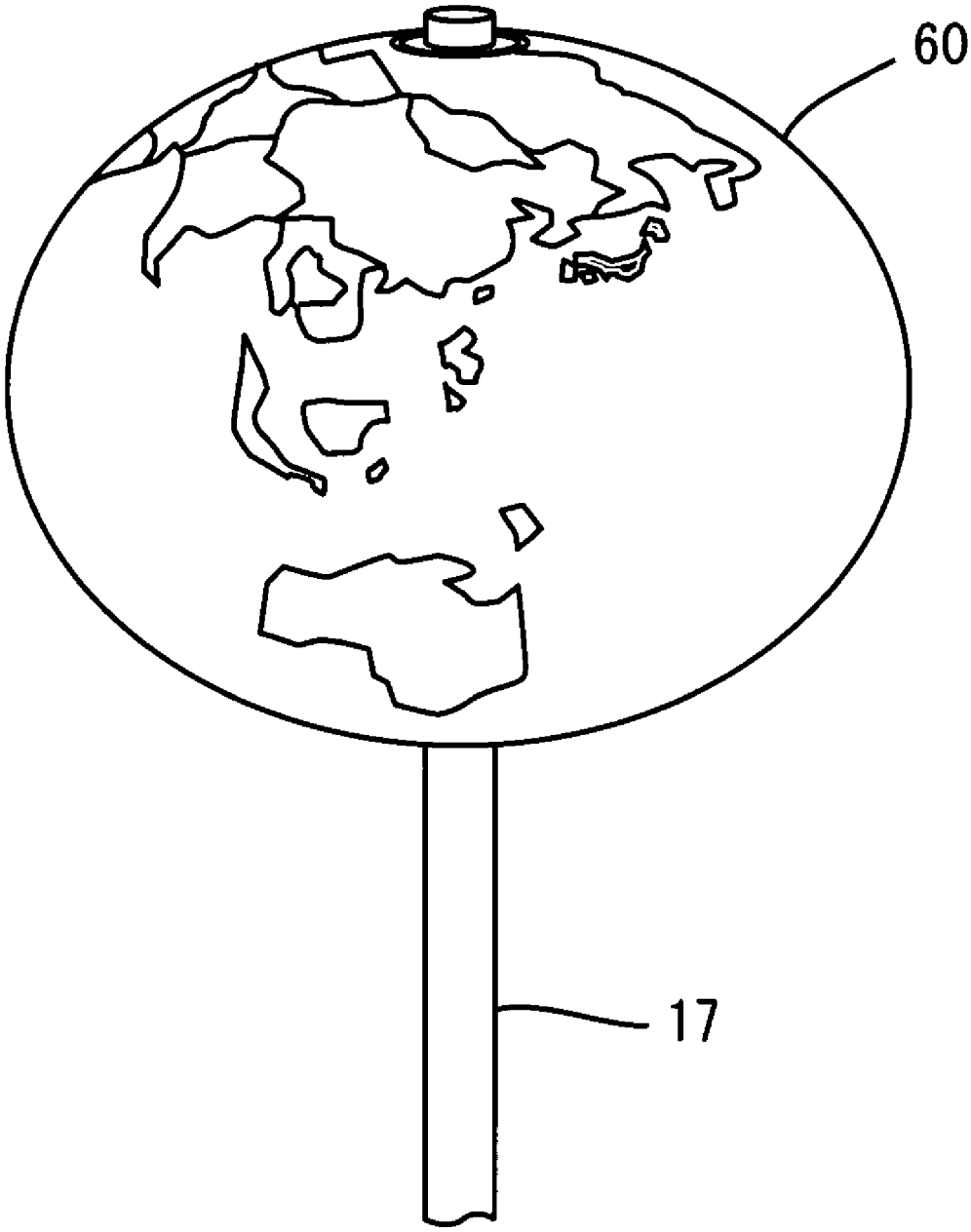
FIG. 4 is a perspective view showing a smart antenna covered by an outer covering unit.

FIG. 4 is a perspective view showing the smart antenna 10 covered by the outer covering unit 60. According to FIG. 4, the smart antenna 10 is covered by the outer covering unit 60 that is in the sphere shape that has a diameter at least larger than that of the thin cylindrical chassis 14 of the smart antenna 10. The sphere shape of the outer covering unit 60 is modeled after globe and capable of rotating around the shaft portion 17 as an axis of rotation. The outer covering unit 60 is formed in the sphere shape in order not to configurate a flat plane on top of the outer covering unit 60 when the outer covering unit 60 covers the smart antenna 10 for preventing something from being placed on the top and in order not to configurate a protruding branch shape for preventing something from being hang on the protruding branch shape. Of course, the outer covering unit 60 modeled after globe is just an example and the outer covering unit 60 can be also modeled after balls used for ball games, planets. Further the shape of the outer covering unit 60 is not limited to the sphere shape.

Figure 5:
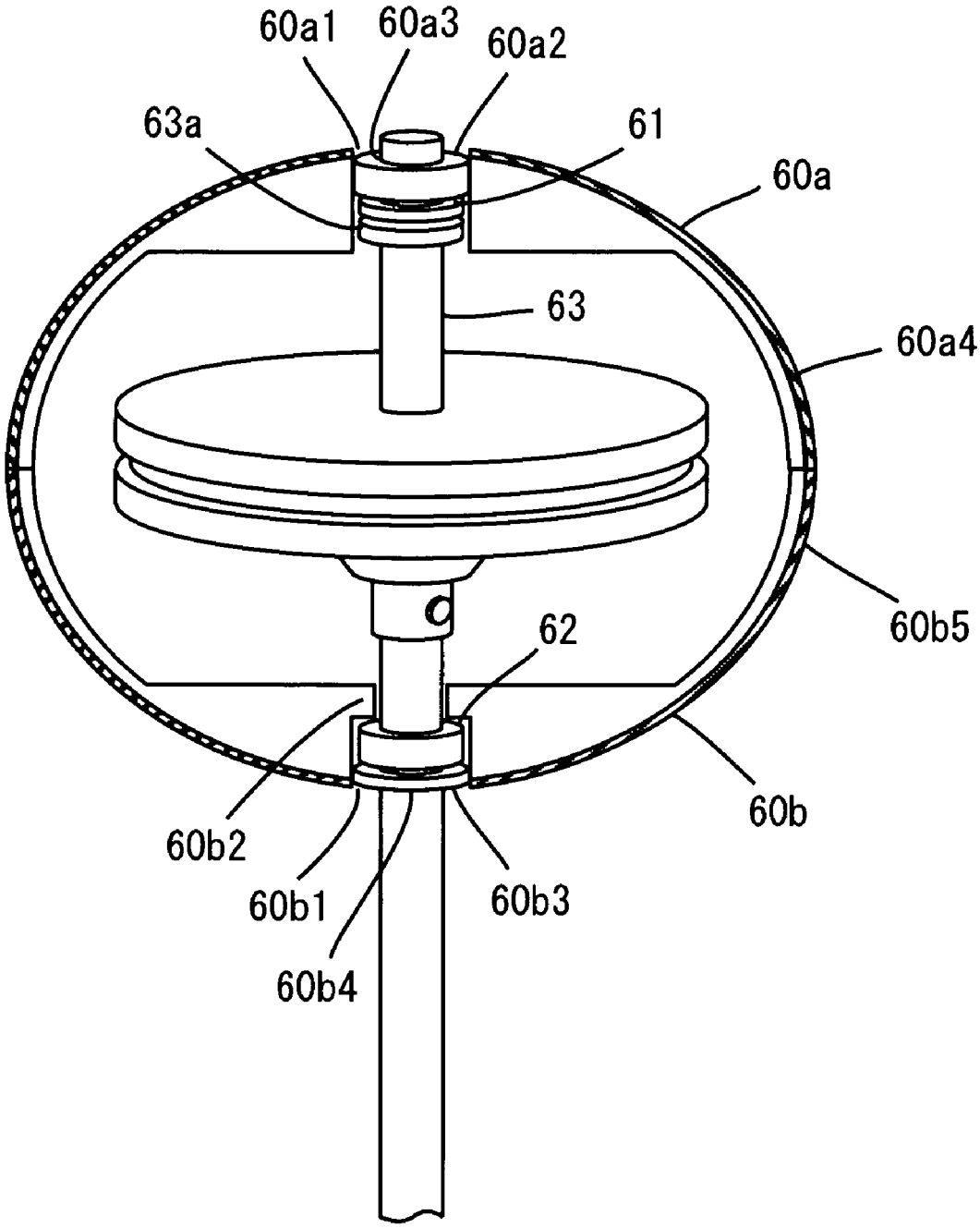
FIG. 5 is a configuration diagram showing inside of the outer covering unit.

FIG. 5 is a configuration diagram showing inside of the outer covering unit 60. According to FIG. 5, the outer covering unit 60 is covering the smart antenna 10 and detachable with the smart antenna 10. For this purpose, the outer covering unit 60 is comprised of an upper covering chassis 60*a*, a lower covering chassis 60*b*, an upper rotation shaft 63 and bearings 61, 62. Each of the upper covering chassis 60*a* and the lower covering chassis 60*b* is formed in a hemisphere shape and has concave portion in their inside. The upper rotation shaft 63 is made of an insulating material and arranged on the extension line of the shaft portion 17 for supporting the rotation of the outer covering unit 60. The bearings 61 and 62 are assembled in order to make the outer covering unit 60 rotate around the shaft portion 17 as the rotation axis. According to the outer covering unit 60 mentioned above, the smart antenna 10 is covered and contained in a space that is formed by unionizing openings of the concave portions of the upper covering chassis 60*a* and the lower covering chassis 60*b*.

The upper rotation shaft 63 is in an axial shape and has a parasol-like structure 63*a* that spreads radially along horizontal directions from a position where is located at a predetermined length from a top edge of the upper rotation shaft 63. As mentioned below, the parasol-like structure 63*a* is configured to support the bearing 61 at a predetermined position. And, another edge of the upper rotation shaft 63 is configured to be detachably fixed to an upper plane of the chassis 14 at the extension line of the shaft portion 17. As an example of a method for fixing the upper rotation shaft 63, screwing the chassis 14 and the edge of the upper rotation shaft 63 is applicable.

As mentioned above, the upper covering chassis 60*a* is formed in the hemisphere shape and has the concave portion in its inside. And outer surface of the upper covering chassis 60*a* is covered by a cushioning part 60*a*4. Therefore, the upper covering chassis 60*a* can protect the smart antenna 10 from impacts coming from outside. And the upper covering chassis 60*a* supports the bearing 61 so that bearing 61 links the outer covering unit 60 and the upper rotation shaft 63 and makes the outer covering unit 60 rotate around the shaft portion 17 as an axis of rotation when the smart antenna 10 is covered by the outer covering unit 60. The upper covering chassis 60*a* is made of an insulating material. The upper covering chassis 60*a* can be made of a cushioning material.

As an example of detailed methods for making the upper covering chassis 60*a* support the bearing 61, a method is explained below. The upper covering chassis 60*a* is comprised of an opening 60*a*1 and a lid part 60*a*2. The opening 60*a*1 is in a cylindrical shape formed around the top of the hemisphere shape of the upper covering chassis 60*a*. A horizontal cross section of the opening 60*a*1 is circular. The lid part 60*a*2 is formed in a cylindrical shape whose diameter is substantially same as that of the opening 60*a*1. An inner surface of the opening 60*a*1 and an outer side surface of the lid part 60*a*2 are threaded in order to detachably fix the lid part 60*a*2 to the upper covering chassis 60*a*.

Further the lid part 60*a*2 has an axis hole 60*a*3 where the upper rotation shaft 63 can penetrate. According to this configuration, the upper rotation shaft 63 can be penetrating upward through the bearing 61 and the axis hole 60*a*3 of the lid part 60*a*2 until the bearing 61 contacts with an upper surface of the parasol-like structure 63*a*. This leads the bearing 61 to be fixed and sandwiched between the lid part 60*a*2 and the parasol-like structure 63*a* in the vertical direction.

The lower covering chassis 60*b* is formed in the hemisphere shape and has the concave portion in its inside such like the upper covering chassis 60*a*. And the lower covering chassis 60*b* configured to be covered by a cushioning part 60*a*5. Further the lower covering chassis 60*b* is configured to support the bearing 62 in order to rotate the lower covering chassis 60*b* around the shaft portion 17 as the axis of the rotation, when the smart antenna 10 is contained in the outer covering unit 60. In addition, the lower covering chassis 60*b* is made of an insulating material. Any cushioning material having insulation properties is applicable for the insulating material.

As an example of a configuration for supporting the bearing 62, an opening 60*b*1 is in a cylindrical shape formed around the lower top of the hemisphere shape of the lower covering chassis 60*b*. A seat 60*b*2 is formed by extending an upper side of an inner side surface of the opening 60*b*1 to inside. Further the lower covering chassis 60*b* has a lid part 60*b*3 formed in a cylindrical shape whose diameter is substantially same as that of the inner side surface of the opening 60*b*1. The inner surface of the opening 60*b*1 and an outer side surface of the lid part 60*b*3 are threaded in order to detachably fix the lid part 60*b*3 to the lower covering chassis 60*b*. The lid part 60*b*3 has an axis hole 60*b*4 wherein the shaft portion 17 can penetrate. The shaft portion 17 penetrates upward through the lid part 60*b*3, the bearing 62 and an inside of the seat 60*b*2. This leads the bearing 62 to be fixed and sandwiched between the lid part 60*b*3 and the seat 60*b*2 in the vertical direction.

The bearings 61 and 62 are penetrated by the upper rotation shaft 63 and the shaft portion 17 in order to make the outer covering unit 60 be capable of rotating around the upper rotation shaft 63 and the shaft portion 17. The bearings 61 and 62 in the present embodiment are in tubular cylindrical shapes and made of an insulating material because they are placed in the outer covering unit 60. Of course the shapes of the bearings 61 and 62 should not limited to the tubular cylindrical shapes and whatever shapes are applicable as long as they are made of insulating materials.

The bearings 61 and 62 placed in the outer covering unit 60 should be configured in order not to prevent the outer covering unit 60 from rotating when the upper rotation shaft 63 and the shaft portion 17 penetrate though the axis holes 60*a*3 and 60*b*4. In particular, it is desirable that the axis holes 60*a*3, 60*b*4, the opening 60*b*1 and 60*b*2 should be directly-aligned.

According to the configuration of the outer covering unit 60 mentioned above, first, the bearings 61 and 62 are set to each of the upper covering chassis 60*a* and the lower covering chassis 60*b*. Next the upper rotation shaft 63 is fixed to the upper plane of the chassis 14 of the smart antenna 10. Further, the upper rotation shaft 63 is inserted in the opening 60*a*1 of the upper covering chassis 60*a* and penetrates through the axis holes 60*a*3 of the bearings 61. The shaft portion 17 is inserted in the opening 60*b*1 of the lower covering chassis 60*b* and penetrates through the axis holes 60*b*4 of the bearing 62. At the end, the upper covering chassis 60*a* and the lower covering chassis 60*b* are unionized. In case removing the outer covering unit 60 from the smart antenna 10, a procedure that is contrary to what described above is applicable.

B2. Another Embodiment

Figure 6:
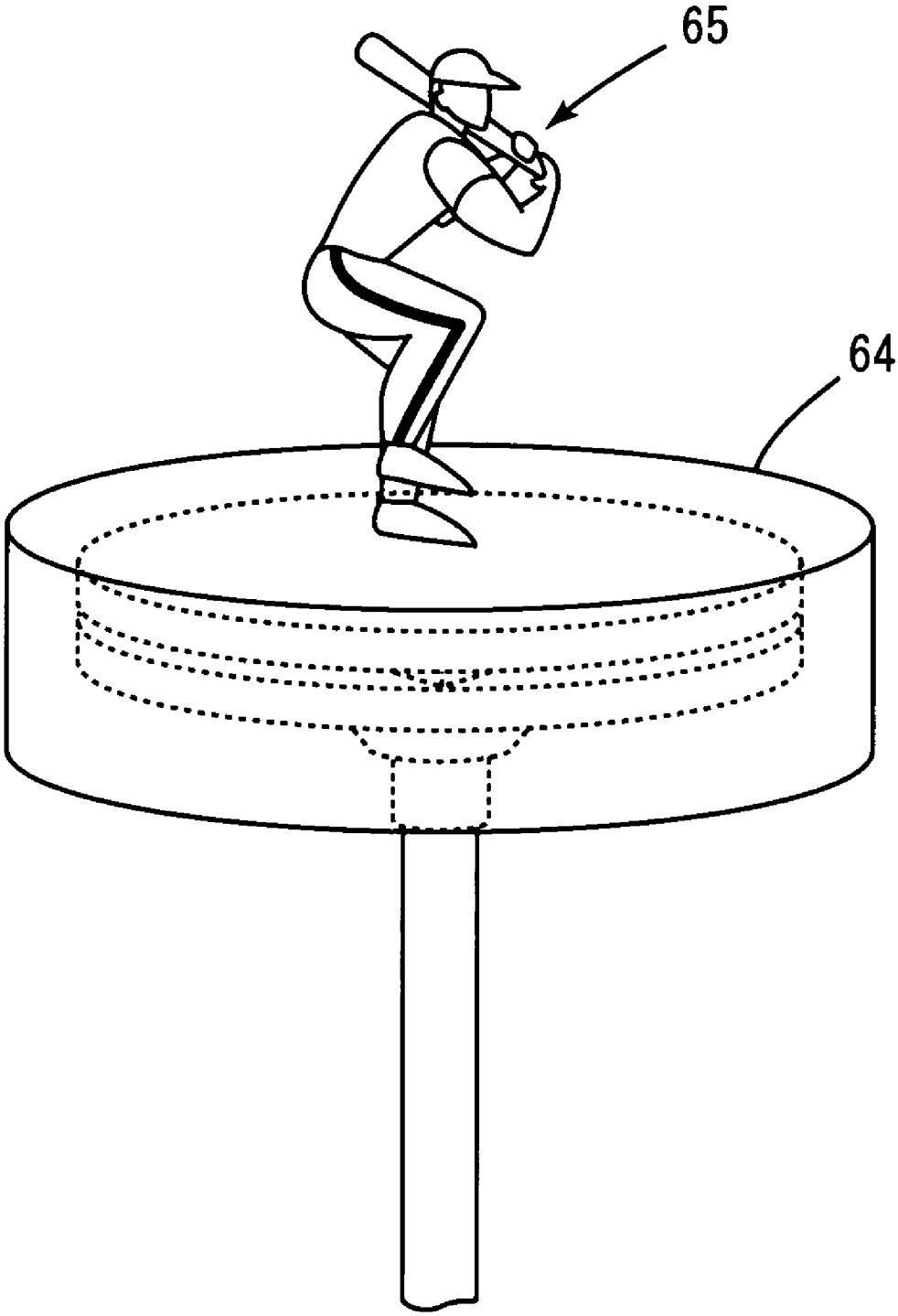
FIG. 6 is a diagram showing the outer covering unit of another embodiment; and, FIG. 7 is a perspective view showing a smart antenna 1 of related art.
Figure 7:
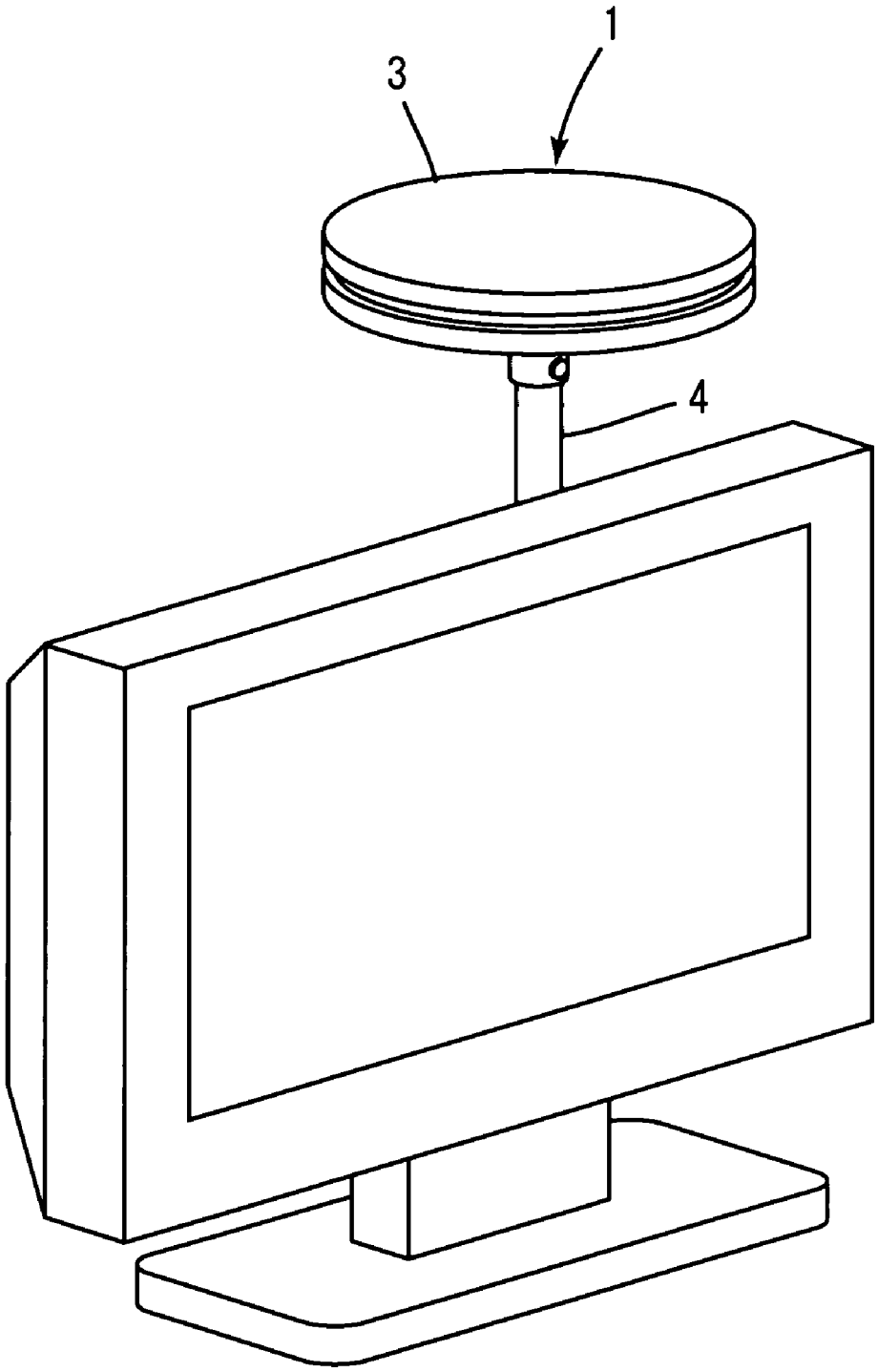

In the embodiment mentioned above, the outer covering unit 60 is formed in the sphere shape. The outer covering unit 60 can be replaced to that of various shapes, because the outer covering unit 60 is detachable to the smart antenna 10. FIG. 6 is a diagram showing the covering unit 160 of another embodiment. According FIG. 6, the covering unit 160 is comprised of a base portion 64 containing the smart antenna 10 and a doll portion 65 placed on an upper plane of the base portion 64. In addition, the base portion 64 and the doll portion 65 are made of insulating materials such like the embodiment mentioned above. Further the smart antenna 10 can be protected from impacts coming from outside by forming the base portion 64 and the doll portion 65 with cushioning materials.

And the shape of the doll portion 65 should not be limited to what shown in FIG. 6, for example, a shape resembling to a tree. By configuring the covering unit 160 in the shape shown in FIG. 6, if ever users placed conductor substances upon the smart antenna 10 covered by the covering unit 160, the conductor substances would be unstable and fall. Therefore it is possible to prevent the users from uncauciously placing the conductor substances upon the smart antenna 10. By changing an appearance of the covering unit 160, the appearance of the covering unit 160 can be harmonized with atmosphere and design of a surrounding area and it is possible to enhance an additional value as an interior accessory.

Further, passive antenna elements can be equipped in the covering unit 60 in order to widen an operative frequency band width of the smart antenna 10. Here, the passive antenna elements are metal plates or metal films that are formed in predetermined shapes corresponding to the operative frequency band of the smart antenna 10. In case the metal plate is used as the passive antenna elements, it is desirable that the metal plate is arranged at a position where is inside or outside of the covering unit 60, is above the smart antenna 10 and is distant from the top of the covering unit 60 by a constant length. And in case the metal films are used as the passive antenna elements, it is desirable that metal film is adhered on inner surface or outer surface of the covering unit 60 with a constant distance from the smart antenna 10.

C. Summary of the Embodiments

As explained above, the smart antenna 10 is covered by the covering unit 60. The covering unit 60 is made of the insulating materials that don't influence magnetic fields generated by the smart antenna 10 for receiving the television broadcasting signals. Therefore, the covering unit 60 doesn't harm the receiver sensitivity of the smart antenna 10. The smart antenna 10 doesn't harm aesthetic appearance when the smart antenna 10 is set around the television receiver 20.

The present invention discloses a smart antenna, comprising: a switch unit that switches a direction for receiving radio waves; and an outer covering unit that covers the smart antenna and is made of an insulating material. In this configuration, resin and fiber are quoted as examples of the insulating material.

And even if the smart antenna is covered by the outer covering unit, it can be assumed that users put conductor substances on the smart antenna covered. As a particular example, it can be assumed that users hang a metal key e.g. at the smart antenna as a hanger. Therefore it is desirable that upper side of the outer covering unit is formed in a substantially sphere shape when the outer covering unit covers the smart antenna covered.

Another aspect of the present invention discloses that the outer covering unit is formed in a shape capable of making something placed on the outer covering unit unstable. In particular, the outer covering unit is formed in the shape in order not to configurate a flat plane on top of the outer covering unit when the outer covering unit covers the smart antenna for preventing something from being placed on the top and in order not to configurate a protruding branch shape for preventing something from being hang on the protruding branch shape. Therefore a sensitivity of the smart antenna cannot be harmed, since users cannot put something on the outer covering unit.

Further, the outer covering unit can provide functions other than the aesthetic appearance and prevention of the sensitivity harm. Therefore one optional aspect of the present invention discloses a smart antenna, wherein: the outer covering unit is made of a cushioning material.

According to this aspect of the present invention, the smart antenna can be protected from impacts coming from outside.

Further, a detailed aspect of the present invention discloses a smart antenna, further comprising: an antenna unit that receives television broadcasting signals as the radio waves; a chassis that contains the antenna unit, is made by a an insulating material and is formed in a thin cylindrical shape whose diameter is horizontal; and a shaft portion that connects the lower plane of the chassis to a television receiver with a predetermined distance between the chassis and the television receiver.

According to this aspect, the antenna unit is contained in the chassis formed in the thin cylindrical shape. And the chassis is connected to the television receiver thorough the shaft portion. And another aspect of the present invention discloses a smart antenna, wherein: the chassis and the outer covering unit rotate are detachably connected. According to this configuration, the outer covering unit can be replaced at user's choice. Therefore, it is possible to provide the smart antenna being harmonized with atmosphere and design of a surrounding area.

And another aspect of the present invention discloses a smart antenna, further comprising: a rotating unit that detachably links the outer covering unit and the chassis and makes the outer covering unit rotate. According to this configuration, it is possible to enhance an additional value as an interior accessory of by adding dynamic alteration to the outer covering unit.

And as a detailed configuration of the rotating unit, one aspect of the present invention discloses a smart antenna, wherein the rotating unit is a bearing inserted by the shaft portion; and the outer covering unit rotates around the shaft portion as an axis of rotation.

According to this configuration, the outer covering unit is rotated around the shaft portion as an axis of rotation by the baring. Therefore, it can be possible to simplify the configuration of the rotating unit.

And as a detailed configuration of the outer covering unit, another aspect of the present invention discloses a smart antenna, wherein: the outer covering unit is formed in a sphere shapes whose diameter is larger than the diameter of the chassis. According to this configuration, the outer covering unit is formed in a sphere shapes whose diameter is larger than the diameter of the chassis. For example, by forming the outer covering unit in a sphere shapes whose diameter is substantially same as the diameter of the chassis, the chassis of the smart antenna can be covered by the outer covering unit that has a minimum size.

And another aspect of the present invention discloses a smart antenna, further comprising: a switch unit that switches a direction where an antenna unit receives television broadcasting signals; a chassis that contains the antenna unit, is made by a an insulating material and is formed in a thin cylindrical shape whose diameter is horizontal; an outer covering unit that covers the smart antenna, is made of an insulating material and is formed in a sphere shape whose diameter is larger than the diameter of the chassis; a shaft portion that connects the lower plane of the chassis to a television receiver with a predetermined distance between the chassis and the television receiver; and a rotating unit have a bearing that detachably links the outer covering unit and the chassis and is inserted by the shaft portion to makes the outer covering unit rotate around the shaft portion as an axis of rotation.

While the invention has been particularly shown and described with respect to preferred embodiments thereof, it should be understood by those skilled in the art that the foregoing and other changes in form and detail may be made therein without departing from the spirit and scope of the invention as defined in the appended claims.

It is to be understood that the present invention is not limited to the embodiments as described above, and that variances described below shall be considered as embodiments disclosed in the present invention.

A variance in which any of the members disclosed in one of the embodiments are appropriately combined with any of those disclosed in the other embodiments and exchangeable with the members.

A variance in which the members and structures disclosed in the embodiments are appropriately exchanged with those disclosed in related arts but not disclosed in the embodiments or appropriately combined with one another.

A variance in which the members and structures disclosed in the embodiments are appropriately exchanged with those thought to be substitutes by a person with ordinary skill in the art but not disclosed in the embodiments, and appropriately combined with one another.

This invention is of course not limited to the above aspects. While of course evident to a practitioner of the art, also disclosed as aspects of the invention are the modification and application of appropriate combinations of mutually substitutable members, configurations and similar, disclosed in the above aspects; the modification and application of appropriate combinations of mutually substitutable members, configurations and similar, which, though not disclosed in the above aspects, employ widely-known technology; and, the modification and application of appropriate combinations of mutually substitutable members, configurations and similar, which, though not disclosed in the above aspects, can be performed by a practitioner of the art based on widely-known technology.

Although the invention has been described in considerable detail in language specific to structural features or method acts, it is to be understood that the invention defined in the appended claims is not necessarily limited to the specific features or acts described. Rather, the specific features and acts are disclosed as preferred forms of implementing the claimed invention. Therefore, while exemplary illustrative embodiments of the invention have been described, numerous variations and alternative embodiments will occur to those skilled in the art. Such variations and alternate embodiments are contemplated, and can be made without departing from the spirit and scope of the invention.

It is to be understood that the phraseology and terminology employed herein, as well as the abstract, are for the purpose of description and should not be regarded as limiting.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, proximal, distal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) is not used to show a serial or numerical limitation but instead is used to distinguish or identify the various members of the group.

What is claimed is:

1. A smart antenna, comprising:

an interface (12) that is connected to a television receiver (20), receives channel information from the television receiver (20) for controlling receiving direction, and outputs the channel information:

an antenna controller (11) that acquires the channel information from the interface (12), judges television broadcasting signals that corresponds to physical channel identification number included in the channel information and selects receiving direction;

a receiving element (13) for receiving television broadcasting signals that is capable of being controlled by the antenna controller (11) to select receiving direction from predetermined plurality of receiving directions, and receives the television broadcasting signal at a higher sensitivity coming from the selected receiving direction than that of the television broadcasting signals from other receiving directions;

a chassis (14) that is comprised of an upper chassis part (14*a*) and a lower chassis part (14*b*) and holds the receiving element (13), the interface(12), and the antenna controller (11) horizontally in the upper chassis part (14*a*) and the lower chassis part (14*b*) when the upper chassis part (14*a*) and the lower chassis part (14*b*) are coupled together, and is formed in a thin cylindrical shape;

an outer covering unit (60) that covers and veils the chassis (14), and is made of an insulating material; and a shaft portion (17) that connects the lower plane of the chassis (14) to the television receiver (20) with a predetermined distance between the chassis (14) and the television receiver (20).

2. A smart antenna as set forth claim 1, wherein:

an upper portion of the outer covering unit (60) is formed in a substantial sphere shape.

3. A smart antenna as set forth claim 1, wherein:

the outer covering unit (60) is made of a cushioning material.

4. A smart antenna as set forth claim 1, wherein:

the chassis (14) and the outer covering unit (60) are detachably connected.

5. A smart antenna as set forth claim 1, further comprising:

a rotating unit (61,62) that links the outer covering unit (60) and the chassis (14) and makes the outer covering unit (60) rotate.

6. A smart antenna as set forth claim 5, wherein:

the rotating unit (61,62) is a bearing inserted by the shaft portion (17); and the outer covering unit (60) rotates around the shaft portion (17) as an axis of rotation.

7. A smart antenna as set forth claim 1, wherein:

the outer covering unit (60) is formed in a sphere shape whose diameter is larger than the diameter of the chassis (14).

* * * * *